US005135846A

United States Patent [19]

Mukunoki et al.

[11] Patent Number: 5,135,846

[45] Date of Patent: Aug. 4, 1992

[54] SILVER HALIDE PHOTOGRAPHIC MATERIAL

[75] Inventors: Yasuo Mukunoki; Tadahiko Kubota, both of Kanagawa, Japan

[73] Assignee: Fuji Photo Film Co., Ltd., Kanagawa, Japan

[21] Appl. No.: 528,669

[22] Filed: May 25, 1990

[51] Int. Cl.[5] ..... G03C 1/94

[52] U.S. Cl. ..... 430/637; 430/527; 430/529; 430/631

[58] Field of Search ..... 430/527, 637, 529, 631

[56] References Cited

U.S. PATENT DOCUMENTS 4,585,730 4/1986 Cho ..... 430/527

4,948,720 8/1990 Chen et al. ..... 430/527

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material is disclosed, comprising a support having thereon at least one of silver halide emulsion layers and other hydrophilic colloid layers, wherein said at least one of silver halide emulsion layers and hydrophilic colloid layers contains both a phosphagen polymer having a polyalkylene oxide group or a polyglycerol group in the side chain thereof and an anionic polymer salt.

10 Claims, No Drawings

SILVER HALIDE PHOTOGRAPHIC MATERIAL

FIELD OF THE INVENTION

The present invention relates to a silver halide photographic material having excellent antistatic properties and, in particular, to a silver halide photographic material containing a phosphagen polymer and an anionic salt polymer having excellent antistatic properties. Incorporation of these polymers for improving the antistatic property does not deteriorate the coating property of the photographic composition used to prepare the photographic material. Additionally, when the photographic material is processed in an automatic developing machine, the photographic material does not contaminate the processing solutions used therein, and the image formed in the processed material is satisfactory without uneven image, despite incorporation of the polymers.

BACKGROUND OF THE INVENTION

Photographic materials are generally composed of an insulating support and photographic layers. As a result, photographic materials often became electrostatically charged due to contact friction between the surface thereof and other materials of either the same or different composition, or due to peeling of the protecting coat or the like from the surface of the photographic material during the manufacture or use thereof. Accumulated static charges are disadvantageous in that the light-sensitive emulsion layer of the photographic material is exposed upon discharge of the accumulated static charges prior to development to result in undesirable spots or arborescent or feathery streaks in the developed photographic material. Such spots or streaks, called static marks, greatly reduce the commercial value of the photographic film or cause the same to lose all commercial value. Since static marks become apparent only after the photographic film has been developed, the problem is extremely troublesome. Additionally, as a secondary problem, the accumulated static charges also result in the adhesion of dust to the surface of the processed or non-processed photographic film, to thereby make uniform coating difficult.

The occurrence of static marks increases with the use of higher sensitive photographic materials and accelerated development thereof. Recently, in particular, photographic materials are more often processed under severe conditions, namely high-speed coating, high-speed picture-taking and high-speed automatic development. As a result, the generation of static marks in photographic materials processed in such a manner is further augmented. Moreover, with the recent increased use of photographic materials, adhesion of dust to the photographic material is being addressed as an important contamination problem in this technical field.

In order to overcome the problem of accumulated static charges, antistatic agents may be added to the photographic material. However, the antistatic agents generally employed in technical fields other than the photographic field are not directly applicable to all photographic materials. Antistatic agents which can be employed in a photographic material must be compatible with the characteristics of the photographic material. Particularly, antistatic agents for use in photographic materials necessarily have an excellent antistatic ability, do not adversely affect photographic characteristics such as sensitivity, fogging graniness and sharpness, do not adversely affect film strength, do not adversely affect the anti-adhesive property (i.e., adhesive resistance) of the material, do not fatigue the processing solutions used for processing of the photographic material, do not stain conveyer rollers of an automatic processor used to process the photographic material and do not lower the adhesive strength between the constitutive layers of the photographic material. Thus, there are many limitations in the application of antistatic agents to photographic materials. Static charges may be controlled by increasing the electroconductivity of the surface of the photographic material, such that the static charges on the surface thereof are dissipated prior to discharge of the accumulated charges.

Accordingly, a number of methods for elevating the electroconductivity of the support and surface layer of photographic materials have heretofore been proposed and a number of moisture-absorbing substances and water-soluble inorganic salts, as well as certain surfactants or polymers have been utilized for this purpose.

Above all, surfactants are important for imparting antistatic properties to a photographic material. For example, the anion, betain or cation surfactants described in U.S. Pat. Nos. 3,082,123, 3,201,251, 3,519,561, 3,625,695, West German Patents 1,552,408, 1,597,472, JP-A-49-85826, JP-A-53-129623, JP-A-54-159223, JP-A-48-19213, JP-B-46-39312, JP-B-49-11567, JP-A-51-46755, JP-A-55-14417 (the terms "JP-A" and "JP-B" as used herein mean "unexamined published Japanese patent application" and "examined Japanese patent publication", respectively); and the nonion surfactants described in JP-B-48-17882, JP-A-52-80023, West German Patents 1,422,809, 1,422,818, Australian Patent 54,441/1951, have been proposed for use as antistatic agents.

However, the above described surfactants are useful only in specific types of film supports, as well as to specific photographic compositions constituting the photographic materials. Accordingly, the above described surfactants do not satisfy the above-described requirements, and are extremely difficult to apply to photographic materials.

On the other hand, JP-B-51-9610 proposes the use of phenolformalin condensate-ethylene oxide adduct polymers as providing an excellent antistatic property, even when the polymers are incorporated into a photographic material along with other coating agents. However, the above-described method also results in contamination of the photographic material and the processing solutions.

JP-A-53-29715 discloses a photographic material containing a particular anionic surfactant and nonionic polyoxyethylene surfactant. However, the material disclosed therein also results in contamination of the processing solutions and conveyer rollers.

JP-A-64-68751 discloses a photographic material containing a polyphosphagen compound. However, the compounds illustrated therein still do not overcome the above described problems Recently, reduction in the use of rinsing water has been desired for preservation of the environment or for economization of water resources, as well as for simplification of the processing apparatus. Reduction in the amount of the replenisher employed is desirable for reducing the processing cost, and an increase in the concentration of the processing solutions is desirable for shortening the processing time. Under such processing conditions recently employed in the photographic field, the above-described problems of contamination of the processing solution and generation of photographic uneven images are pronounced, such that the development of techniques for overcoming these problems are becoming much more important.

SUMMARY OF THE INVENTION

A first object of the present invention is to provide a photographic material containing an antistatic agent which does not contaminate the processing solutions used for processing the photographic material.

A second object of the present invention is to provide a photographic material containing an antistatic agent which forms an even image after development.

A third object of the present invention is to provide a photographic material containing an antistatic agent, wherein the photographic compositions constituting the photographic material are uniformly coated onto the support of the photographic material, despite the presence of the antistatic agent.

The above objectives have been attained by a silver halide photographic material comprising a support having thereon at least one of silver halide emulsion layers and other hydrophilic colloid layers wherein said at least one of silver halide emulsion layers and hydrophilic colloid layers contains both a phosphagen polymer having a polyalkylene oxide group or a polyglycerol group in the side chain thereof and an anionic polymer salt.

DETAILED DESCRIPTION OF THE INVENTION

The phosphagen polymer that is contained in the photographic material of the present invention has a polyalkylene oxide group or a polyglycerol group in the side chain thereof, and has an excellent antistatic ability. In accordance with the present invention, the photographic material additionally contains an anionic polymer salt. Surprisingly, the present inventors have discovered that the photographic material of the present invention satisfies all of the above-noted objectives namely the processing solutions is not contaminated upon processing of the photographic material, the developed image is free from unevenness, and the coating property of the photographic compositions constituting the photographic material is good.

The phosphagen polymer for use in the present invention having a polyalkylene oxide group or a polyglycerol group in the side chain thereof, is described in detail below.

The phosphagen polymer for use in the present invention comprises repeating units represented by formula (I):

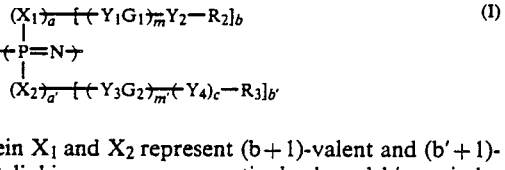

(I)

wherein $X_1$ and $X_2$ represent (b+1)-valent and (b'+1)-valent linking groups, respectively; b and b' are independently 1 or 2; when b and b' are 1, $X_1$ and $X_2$ each represents $-Y_5L_1-$; $L_1$ represents a divalent linking group selected from an alkylene group, an arylene group or an aralkylene group, preferably having a total carbon number of from 1 to 12; when b and b' are 2, $X_1$ and $X_2$ are each represents a group represented by formula (II):

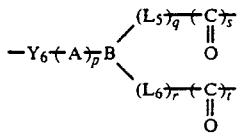

(II)

where A represents

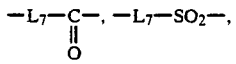

an alkylene group having from 1 to 6 carbon atoms, an arylene group having from 1 to 10 carbon atoms or an aralkylene group;

B represents

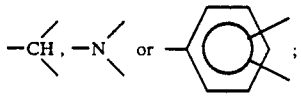

$L_5$, $L_6$ and $L_7$ may be same or different and each has the same meaning as $L_1$; and p, q, r, s and t are independently 0 or 1.

In the above formulae, $Y_1$, $Y_3$, $Y_5$ and $Y_6$ may be same or different and each represents

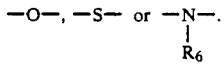

$R_6$ represents a hydrogen atom or an alkyl or alkenyl group having from 1 to 6 carbon atoms. The alkyl or alkenyl group for $R_6$ may be substituted. Examples of the substituents include a halogen atom, a cyano group, a sulfo group, a hydroxyl group, a carboxyl group, an alkyl group, an aryl group, an aralkyl group, an acyloxy group, an acylamino group, an amino group, a sulfonamido group, an alkoxy group, an aryloxy group, an alkylthio group, an arylthio group, a carbamoyl group, a sulfamoyl group, an alkoxycarbonyl group, an aryloxycarbonyl group, an alkylsulfonyl group, an arylsulfonyl group, an alkoxysulfonyl group, an aryloxysulfonyl group, a carbamoylamino group, a sulfamoylamino group, a carbamoyloxy group, an alkoxycarbonylamino group and an aryloxycarbonylamino group.

Examples of $X_1$ and $X_2$ are as follows:

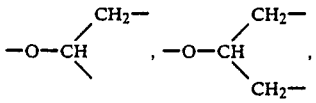

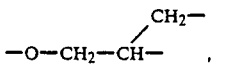

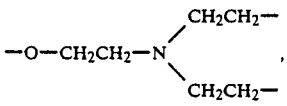

-continued

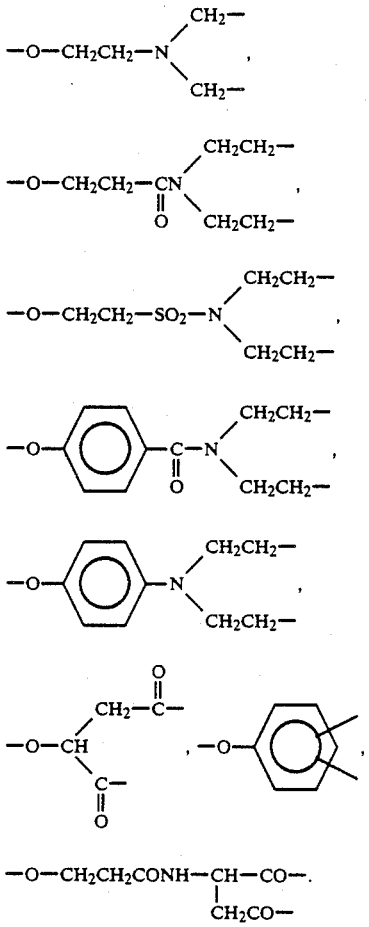

The linking groups $X_1$ and $X_2$ preferably have from 1 to 12 carbon atoms, and these linking groups are optionally substituted. Examples of substituents for the linking groups are the same as those described for $R_6$ above.

a and a' are 0 or 1; provided that when a and a' are both 0 (zero), b and b' are 1 (one). $Y_2$ and $Y_4$ are the same or different and each represents —O—, —S—,

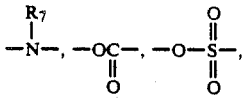

or an alkylene group having from 1 to 6 carbon atoms. $R_7$ has the same meaning as $R_6$. c represents 0 or 1.

$G_1$ and $G_2$ may be same or different and each represents

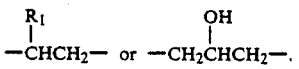

$R_1$ represents a hydrogen atom or an alkyl group having from 1 to 4 carbon atoms and is preferably a hydrogen atom or a methyl group.

When a is 0, $Y_1$ and $Y_2$ are both —O—, $R_2$ is hydrogen atom and $G_1$ is

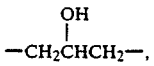

the moiety $-(X_1)_a[(Y_1G_1)_m Y_2-R_2]_b$ is a polyglycerol group. The polyglycerol group is represented by formula (III) or by a mixture comprising the polyglycerol groups represented by the formulae (III) and (IV):

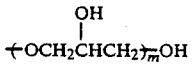

(III)

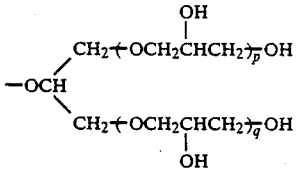

(IV)

wherein m, p and q satisfy the relation of $m=p+q+1$.

The polyglycerol group as further described below is represented by $-(OC_3H_6O_2)_m-H$.

$R_2$ and $R_3$ are the same or different and each represents a hydrogen atom, an alkyl or alkenyl group having from 1 to 4 carbon atoms, or

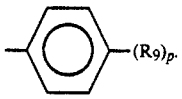

$R_9$ represents a monovalent substitutable group. Examples of the group are an alkyl group having from 1 to 20 carbon atoms, a substituted alkyl group, a halogen atom (e.g., fluorine, chlorine, bromine, iodine), a hydroxyl group, a carboxyl group, a sulfo group, an acylamino group (e.g., acetamido, benzamido), a sulfonamide group, a carbamoyl group, an acyloxy group, an alkoxycarbonyl group, an acyl group, an alkoxy group (e.g., methoxy), an aromatic-oxy group (e.g., phenoxy), a nitro group, a formyl group, an aliphatic sulfonyl group and an aromatic sulfonyl group. Substituents for the alkyl monovalent substitutable group include, for example, an alkoxy group, an aryloxy group, an alkoxycarbonyl group, an acylamino group, a carbamoyl group, an acyloxy group, an acyl group, an aliphatic-oxy group, an aromatic oxy group and a nitro group. Two or more $R_2$ and $R_4$ groups, if any, may be the same or different.

$R_9$ is preferably an alkyl group having from 1 to 3 carbon atoms or a methoxy group.

p is an integer of from 0 to 5.

$R_2$ and $R_3$ each are preferably a hydrogen atom, a methyl group or an aryl group.

m and m' are independently an integer of from 1 to 30, preferably from 1 to 15.

The phosphagen polymer for use in the present invention may comprise plurality of repeating unit represented by formula (I), and may contain other repeating units in addition to the repeating unit represented by formula (I). A repeating unit of the following formula (V), for example, may be contained in the phosphagen polymer.

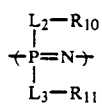

(V)

wherein $R_{10}$ and $R_{11}$ may be the same or different and each represents an alkyl, alkenyl, aryl or aralkyl group having from 1 to 12 carbon atoms or an $-(R_{12}O)_e-R_{13}$ group, which may be further substituted. Examples of the substituents include the substituents for $R_6$ described above. $R_{12}$ represents an alkylene group having from 2 to 4 carbon atoms and e is 1, 2 or 7. $R_{13}$ represents an alkyl, alkenyl, aryl or aralkyl group, having a total carbon number of from 1 to 12. $R_{10}$ and $R_{11}$ each is preferably an alkyl or alkenyl group having from 1 to 6 carbon atoms. $L_2$ and $L_3$ have the same meanings as $Y_1$, $Y_3$, $Y_5$ and $Y_6$.

Preferably, the repeating unit represented by formula (I) comprise 50 mol % to 100 mol %, more preferably 80 mol % to 100 mol % and particularly preferably 100 mol % of the phosphagen polymer of the present invention.

Preferably, the phosphagen polymer for use in the present invention has a weight average molecular weight of from 1,000 to 3,000,000 and more preferably from 50,000 to 3,000,000, calculated on the basis of polystyrene.

Specific nonlimiting examples of the phosphagen polymer compounds for use in the present invention are described below. In the formulae below, a and b each indicate the proportion (mol %) of the repeating units in the polymer compound.

Compound No. 1 (P-1):

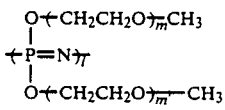

m = 2, m' = 2, $M\overline{w}$: about 360,000

Compound No. 2 (P-2):

In the formula of Compound No, 1, m = 3, m' = 3, $M\overline{w}$: about 280,000

Compound No. 3 (P-2):

In the formula of Compound No. 1, m = 4, m' = 4, $M\overline{w}$: about 275,000

Compound No. 4 (P-4):

In the formula of Compound No. 1, m = 9, m' = 9, $M\overline{w}$: about 234,000

Compound No. 5 (P-5):

In the formula of Compound No. 1, m = 12, m' = 12, $M\overline{w}$: about 197,000

Compound No. 6 (P-6):

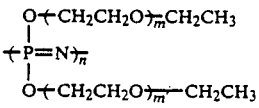

m = 2, m' = 2, $M\overline{w}$: about 316,000

Compound No. 7 (P-7):

In the formula of Compound No. 6, m = 3, m' = 3, $M\overline{w}$: about 286,000

-continued

Compound No. 8 (P-8):

In the formula of Compound No. 6, m = 4, m' = 4, $M\overline{w}$: about 277,000

Compound No. 9 (P-9):

In the formula of Compound No. 6, m = 9, m' = 9, $M\overline{w}$: about 196,000

Compound No. 10 (P-10):

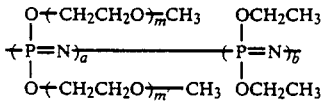

m = 2, m' = 2, a/b = 95/5, $M\overline{w}$: about 173,000

Compound No. 11 (P-11):

In the formula of Compound No. 10, m = 3, m' = 3, $M\overline{w}$: about 166,000

Compound No. 12 (P-12):

In the formula of Compound No. 10, m = 4, m' = 4, $M\overline{w}$: about 174,000

Compound No. 13 (P-13):

In the formula of Compound No. 10, m = 11, m' = 11, $M\overline{w}$: about 120,000

Compound No. 14 (P-14):

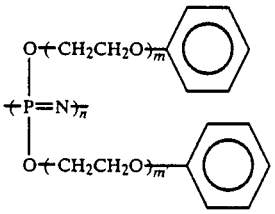

m = 4, m' = 4, $M\overline{w}$: about 239,000

Compound No. 15 (P-15):

In the formula of Compound No. 14, m = 12, m' = 12, $M\overline{w}$: about 196,000

Compound No. 16 (P-16):

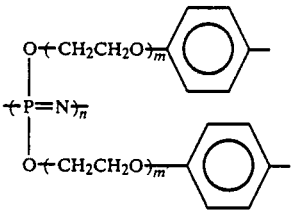

m = 4, m' = 4, $M\overline{w}$: about 168,000

Compound No. 17 (P-17):

In the formula of Compound No. 17, m = 9, m' = 9, $M\overline{w}$: about 232,000

Compound No. 18 (P-18):

-continued

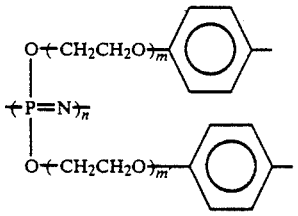

m = 4, m' = 4, $M\overline{w}$: about 148,000

Compound No. 19 (P-19):

In the formula of Compound No. 18, m = 9, m' = 9, $M\overline{w}$: about 119,000

Compound No. 20 (P-20):

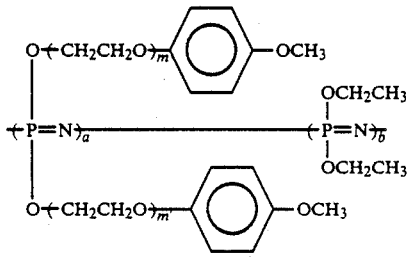

m = 4, m' = 4, a/b = 95/5, $M\overline{w}$: about 153,000

Compound No. 21 (P-21):

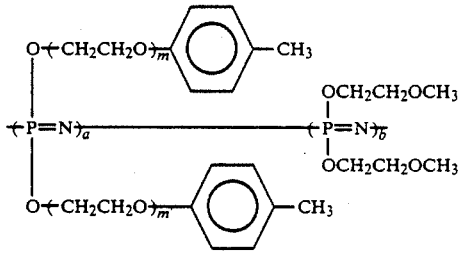

m = 3, m' = 3, a/b = 95/5, $M\overline{w}$: about 160,000

Compound No. 22 (P-22):

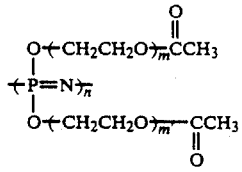

m = 4, m' = 4, $M\overline{w}$: about 192,000

Compound No. 23 (P-23):

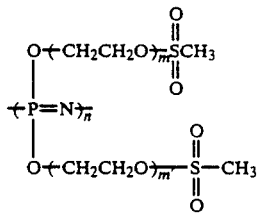

m = 4, m' = 4, $M\overline{w}$: about 36,000

Compound No. 24 (P-24):

-continued

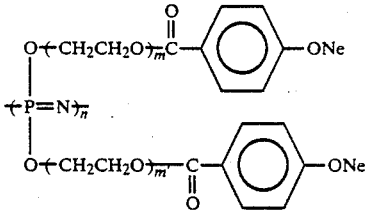

m = 2, m' = 2, $M\overline{w}$: about 188,000

Compound No. 25 (P-25):

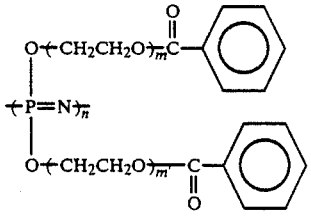

m = 2, m' = 2, $M\overline{w}$: about 246,000

Compound No. 26 (P-26):

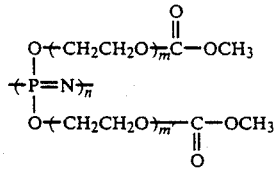

m = 2, m' = 2, $M\overline{w}$: about 66,000

Compound No. 27 (P-27):

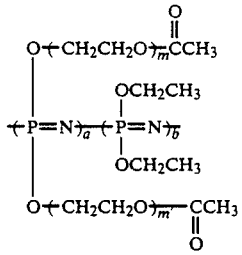

m = 4, m' = 4, a/b = 95/5, $M\overline{w}$: about 53,000

Compound No. 28 (P-28):

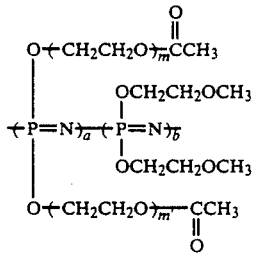

m = 3, m' = 3, a/b = 95/5, $M\overline{w}$: about 84,000

Compound No. 29 (P-29):

-continued

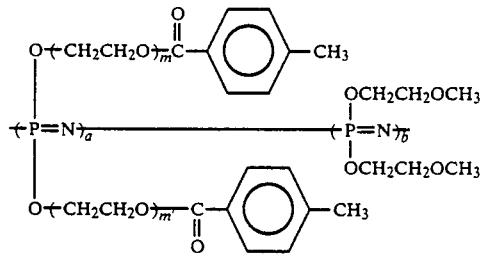

m = 2, m' = 2, a/b = 95/5, $M\overline{w}$: about 168,000

Compound No. 30 (P-30):

m = 5, m' = 5, $M\overline{w}$: about 32,000

Compound No. 31 (P-31):

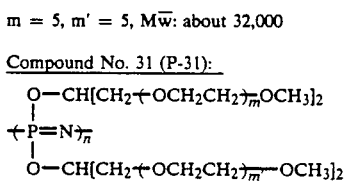

m = 2, m' = 2, $M\overline{w}$: about 45,000

Compound No. 32 (P-32):

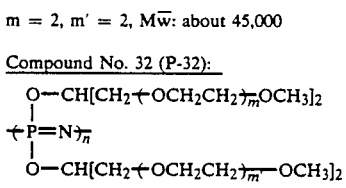

m = 3, m' = 3, $M\overline{w}$: about 118,000

Compound No. 33 (P-33):

m = 3, m' = 3, $M\overline{w}$: about 42,000

Compound No. 34 (P-34):

m = 2, m' = 2, $M\overline{w}$: about 89,000

Compound No. 35 (P-35):

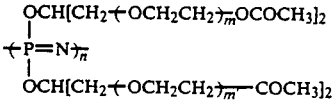

m = 2, m' = 2, $M\overline{w}$: about 89,000

Compound No. 36 (P-36):

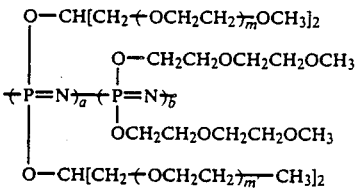

-continued m = 2, m' = 2, a/b = 90/10, $M\overline{w}$: about 186,000

Compound No. 37 (P-37):

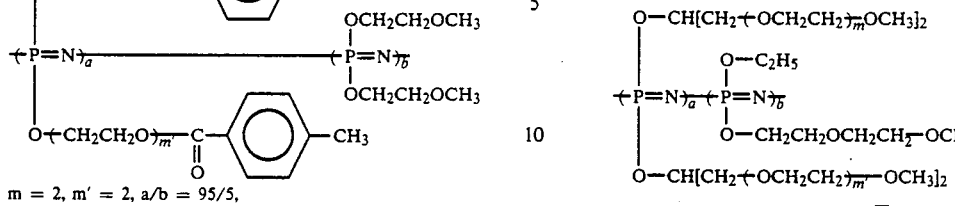

m = 2, m' = 2, a/b = 90/10, $M\overline{w}$: about 154,000

Compound No. 38 (P-38):

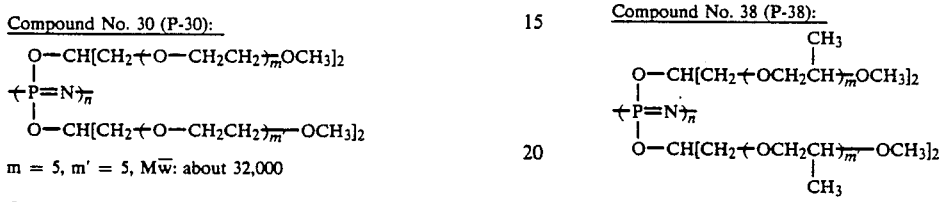

m = 3, m' = 3, $M\overline{w}$: about 132,000

Compound No. 39 (P-39):

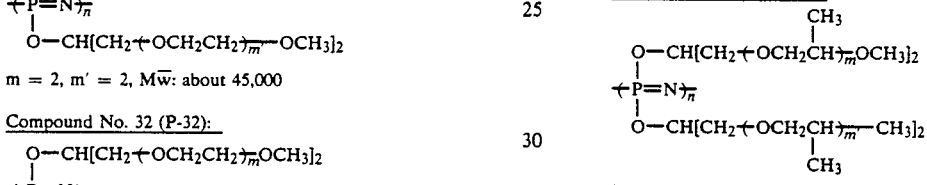

m = 3, m' = 3, $M\overline{w}$: about 68,000

Compound No. 40 (P-40):

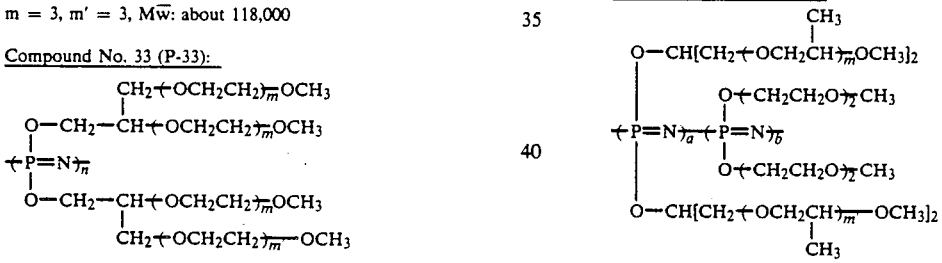

m = 2, m' = 2, a/b = 95/15, $M\overline{w}$: about 89,000

Compound No. 41 (P-41):

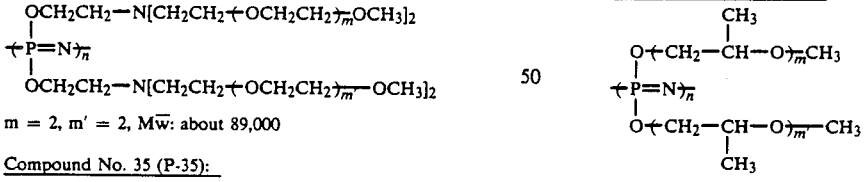

m = 4, m' = 4, $M\overline{w}$: about 256,000

Compound No. 42 (P-42):

In the formula of Compound No. 42, m = 7, m' = 7, $M\overline{w}$: about 210,000

Compound No. 43 (P-43):

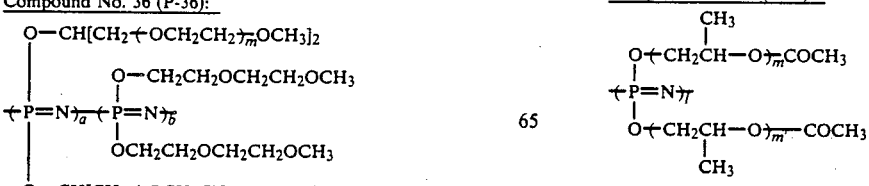

m = 7, m' = 7, $M\overline{w}$: about 163,000

-continued

Compound No. 44 (P-44):

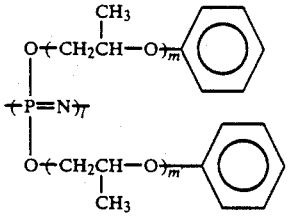

m = 2, m' = 2, $M\overline{w}$: about 134,000

Compound No. 45 (P-45):

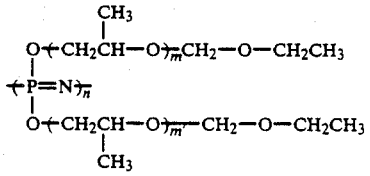

m = 3, m' = 3, $M\overline{w}$: about 156,000

Compound No. 46 (P-46):

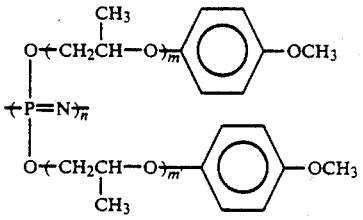

m = 3, m' = 3, $M\overline{w}$: about 212,000

Compound No. 47 (P-47):

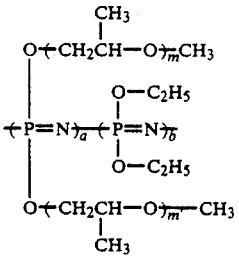

m = 2, m' = 2, a/b = 95/5, $M\overline{w}$: about 130,000

Compound No. 48 (P-48):

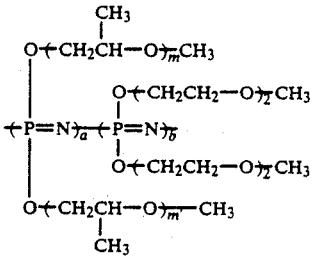

m = 2, m' = 2, a/b = 95/5, $M\overline{w}$: about 126,000

Compound No. 49 (P-49):

-continued

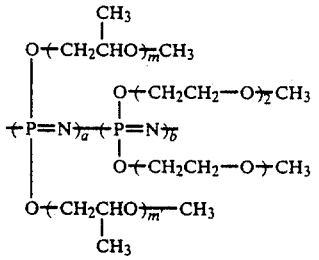

m = 2, m' = 2, a/b = 70/30, $M\overline{w}$: about 89,000

Compound No. 50 (P-50):

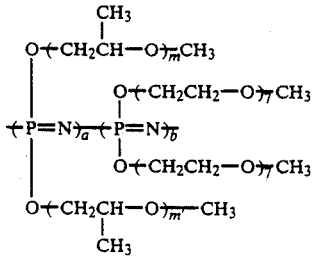

m = 3, m' = 3, a/b = 70/30, $M\overline{w}$: about 65,000

Compound No. 51 (P-51):

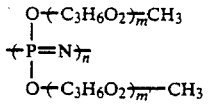

m = 3, m' = 3, $M\overline{w}$: about 120,000

Compound No. 52 (P-52):

In the formula of Compound No. 51, m = 2, m' = 2, $M\overline{w}$: about 180,000

Compound No. 53 (P-53):

In the formula of Compound No. 51, m = 4, m' = 4, $M\overline{w}$: about 150,000

Compound No. 54 (P-54):

In the formula of Compound No. 51, m = 7, m' = 7, $M\overline{w}$: about 110,000

Compound No. 55 (P-55):

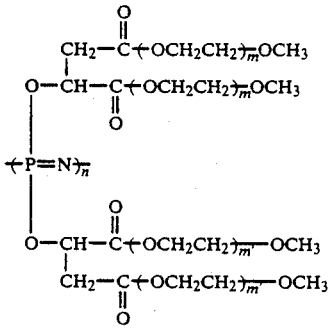

m = 2, m' = 2, $M\overline{w}$: about 54,000

Compound No. 56 (P-56):

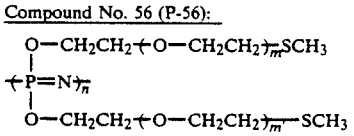

m = 3, m' = 3, $M\overline{w}$: about 73,000

-continued

Compound No. 57 (P-57):

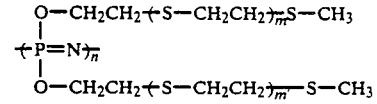

m = 2, m' = 2, $M\bar{w}$: about 36,000

Compound No. 58 (P-58):

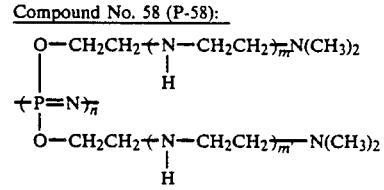

m = 2, m' = 2, $M\bar{w}$: about 59,000

Compound No. 59 (P-59):

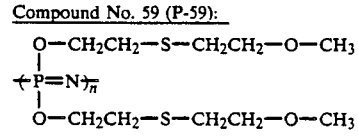

$M\bar{w}$: about 69,000

Compound No. 60 (P-60):

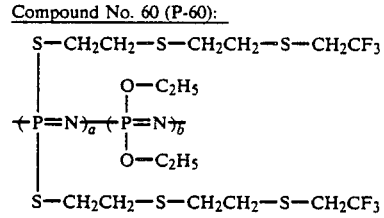

a/b = 90/10, $M\bar{w}$: about 42,000

Compound No. 61 (P-61):

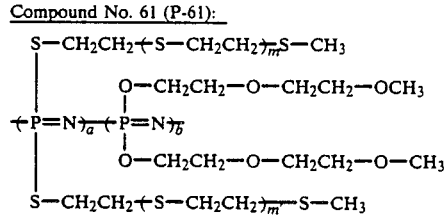

a/b = 95/5, m = 2, m' = 2, $M\bar{w}$: about 38,000

Compound No. 62 (P-62):

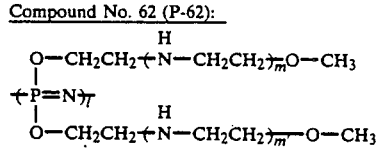

m = 2, m' = 2, $M\bar{w}$: about 95,000

Compound No. 63 (P-63):

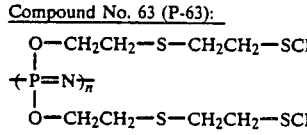

$M\bar{w}$: about 46,000

SYNTHESIS EXAMPLE 1

Preparation of (P-1)

(1) Preparation of Polydichlorophosphagen 100 g (0.29 mol) of $(NPCl_2)_3$ was paced in a heat resistant glass tube. Under vacuum ($10^{-2}$ Torr), and the tube was sealed. The tube was placed in an electric oven at 250° C. and reacted for 20 hours.

After the reaction, the contents were removed, and the non-reacted raw material was separated from the reacted material by sublimation at 50° C. for 25 hours to obtain polydichlorophosphagen in a yield of 85 grams.

(2) Preparation of (P-1)

540 g of

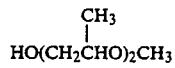

was dissolved in 2 liters of tetrahydrofuran, and 14 g (0.35 mol) of 60% sodium hydride was added thereto. To the resulting solution was dropwise added 400 ml of a tetrahydrofuran solution containing 20 g of polydichlorophosphagen with stirring at room temperature. Next, 0.1 g of n-butylammonuim bromide was added thereto and reacted for 24 hours at room temperature and then heated under reflux for 2 hours to carry out a reaction. After the reaction, the reaction system was neutralized with a dilute hydrochloric acid and the non-reacted

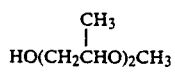

was removed.

The polymer thus obtained was dissolved in 400 ml of acetone, and 5 liters of hexane was added thereto to precipitate the polymer. The operation was repeated twice and, as a result, a yellowish white sticky solid was obtained. Yield: 380 g. Mw=360,000. The chemical structure of the product was confirmed by $^{31}$P-NMR, $^{1}$H-NMR and IR.

The anionic polymer salt for addition to the photographic material of the present invention is described in detail below.

The anionic polymer for use in the present invention contains a metal ion belonging to the Groups Ia and IIa of the Periodic Table. By incorporation of the anionic polymer salt to the photographic material of the present invention along with the above described phosphagen polymer, the antistatic ability of the material is enhanced.

Nonlimiting examples of anionic polymers for use in forming the anionic polymer salt of the present invention include polystyrenesulfonic acid, polyacrylic acid, polyvinyl-phosphoric acid, 2-acrylamido-2-methylpropanesulfonic acid, polymethacrylic acid, polyethylenesulfonic acid and glyoxylic acid.

Other useful anionic polymers include the polymers described in S. Nakamura, *Water-Soluble High Polymers* (published by Kagaku Kogyo-sha, Japan) and S. Murahashi et al, *Synthetic High Polymers III* (published by Asakura Shoten Co., Japan). For example, anionic polymers for use in forming the anionic salt of the present invention as described in the above noted publications include alginic acid, carboxymethyl cellulose, luteic acid, succinoglucan, copolymer of methyl vinyl ether and maleic anhydride, carboxymethyl starch, polyitaconic acid, poly-alpha-ethylacrylic acid, poly-alpha-chloroacrylic acid, poly-alpha-fluoroacrylic acid, poly-alpha-(acylamido)acrylic acid, poly-alpha-(formamido)acrylic acid, poly-alpha-(acetamido)acrylic acid, poly-alpha-(benzamido)acrylic acid, poly-alpha- (phenylacetamido)acrylic acid, poly-alpha-(carboethoxyamido)acrylic acid, poly-alpha-(chloroacetamido)acrylic acid, poly-alpha-(phthalimidoacrylic acid), polycrotonic acid, polycinnamic acid, polymaleic acid and polyfumaric acid. The anionic polymer salts for use in the present invention are slats of the above polymers with metal ions belonging to the Groups Ia and IIa of the Periodic Table.

Two or more kinds of these salts can be employed in combination in the present invention.

Preferred metal ions for forming the salts are Li, Na, K, Mg and Ca.

The anionic polymer salts have a molecular weight of preferably from 10,000 to 1,000,000, more preferably from 10,000 to 300,000.

The anionic polymer salts may contain plural repeating units each having an anionic group in the side chain, and may additionally contain other repeating units derived, for example, from polystyrene, polyvinyl alcohol, acrylamide and vinyl acetate.

Examples of the anionic polymer include lithium polystyrenesulfonate, sodium polystyrenesulfonate, sodium polyacrylate, lithium polyacrylate, sodium polymethacrylate, potassium polymethacrylate, sodium polyethylenesulfonate and potassium polyethylenesulfonate.

In accordance with the present invention, excess salts of metal ions belonging to the Groups Ia and IIa of the Periodic Table may be further added to the photographic material in a amount of generally 10 to 100 wt % and preferably 20 to 60 wt % per the weight of the anionic polymer. Preferred nonlimiting examples of the metal ion salts for use in the present invention are described below.

$KCF_3SO_3$, $NaCF_3SO_3$, $LiCF_3SO_3$, $Ca(CF_3SO_3)_2$, $Zn(CF_3SO_3)_2$, $KBF_4$, $NaBF_4$, $LiBF_4$, $KCF_3CO_2$, $NaCF_3CO_2$, $LiCF_3CO_2$, $KC_3F_7CO_2$, $NaC_3F_7CO_2$, $LiC_3F_7CO_2$, $KC_3F_7SO_3$, $NaC_3F_7SO_3$, $KC_4F_9SO_3$, $KPF_6$.

The polymer compounds (i.e., the phosphagen polymer having a polyalkylene oxide group or a polyglycerol group in the side chain thereof and the anionic polymer salt) of the present invention as described above may be added to the hydrophilic organic colloid or to the organic solvent-containing coating composition for the backing layer, for use as an antistatic agent.

The compounds (i.e., the phosphagen polymer and the anionic polymer salt) of the present invention, may be added to at least one layer of the silver halide emulsion layers and other hydrophilic colloid layers in the photographic material, preferably hydrophilic colloid layers (including layers, e.g., a subbing layer formed by a coating solution using a solvent containing water), including for example, a surface protective layer, a backing layer, an interlayer and a subbing layer. Especially preferably, the compounds are added to the surface protective layer, backing layer or subbing layer.

Where the surface protective layer, backing layer or subbing layer is composed of two or more constitutive layers, the compounds of the present invention may be added to any of the constitutive layers thereof. The compounds of the present invention may also be coated over the protective layer as an overcoating layer.

For addition to the photographic material, the present invention are dissolved in water or an organic solvent such as methanol, ethanol, isopropanol, methyl ethyl ketone or acetone or a mixed solvent thereof. The resulting solution is then added to a coating composition (i.e., a coating solution) for forming a protective layer, backing layer or the like, and the composition is coated on the support by dip-coating, air-knife coating or spraying or by extusion-coating with a hopper as described in U.S. Pat. No. 2,681,294. Alternatively, the coating composition may also be coated by the methods described in U.S. Pat. Nos. 3,508,947, 2,941,898 or 3,526,528, where two or more layers are coated simultaneously on the support, or where the support is dipped in an antistatic agent-containing solution. An antistatic agent solution containing the compounds of the present invention (which also may contain a binder such as gelatin or polystyrene sulfonic acid, if desired) may also be coated over the protective layer.

The phosphogen polymer and the anionic polymer salt of the present invention are each added to the photographic material in an amount of from 0.0001 to 2.0 g, and especially preferably from 0.0005 to 0.3 g, per $m^2$ of the photographic material.

If desired, two or more different kinds of the both compounds of the present invention may be employed in combination.

The present invention may be applied to various photographic materials, including black-and-white silver halide photographic materials (for example, picture-taking black-and-white photographic materials, X-ray black-and-white photographic materials, printing black-and-white photographic materials), ordinary multi-layered color photographic materials (for example, color negative films, color reversal films, color positive films, movie color negative films) and laser scanner infrared-sensitive photographic materials.

Kinds and manufacture methods of the silver halide as well as the antifoggants, stabilizers, hardening agents, antistatic agents, couplers, plasticizers, lubricants, coating aids, matting agents, brightening agents, spectral-sensitizing agents, dyes, ultraviolet absorbents and other additives for use in the silver halide emulsion layers and other constitutive layers such as a protective layer of the photographic material of the present invention and chemical sensitizing methods are not particularly limited. The disclosure of *Product Licensing*, Vol. 92, pages 107 to 110 (December, 1971), *Research Disclosure*, Vol. 176, pages 22 to 31 (December, 1978) and ibid., Vol. 238, pages 44 to 46 (1984) are referred to in regard to the above additives and methods for the use thereof.

The photographic material of the present invention may contain various surfactants in the photographic emulsion layers or other hydrophilic colloid layer as coating aids or for other purposes such as the prevention of static charges, improvement of sliding properties, emulsification and dispersion, prevention of adhesion and improvement of photographic characteristics (for example, acceleration of development, increase of contrast and increase of sensitivity).

Various surfactants can be used for the above described purposes, including, for example, nonionic surfactants such as saponins (especially, steroid saponins), alkylene oxide derivatives (for example, polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, siliconepolyethylene oxide adduct), glycidol derivatives (for example, alkenylsuccinic acid polyglycerides, alkylphenol polyglycerides), fatty acid esters of polyvalent alcohols or alkyl esters of saccharides; anionic surfactants containing acidic groups such as a carboxyl group, a sulfo group, a phospho group, a sulfate group or a phosphate group, (for example, alkylcarboxylic acid salts, alkylsulfonic acid salts, alkylbenzenesulfonic acid salts, alkylnaphthalenesulfonic acid salts, alkylsulfates, alkylphosphates, N-acyl-N-alkyltaurins, sulfosuccinates, sulfoalkylpolyoxyethylene alkylphenyl ethers or polyoxyethylene alkylphosphates); amphoteric surfactants such as amino acids, aminoalkylsulfonic acids, aminoalkylsulfates, aminoalkylphosphates, alkylbetaines or amine oxides; and cationic surfactants such as alkylamine salts, aliphatic or aromatic quaternary ammonium salts, heterocyclic quaternary ammonium salts such as pyridinium salts or imidazolium salts, or aliphatic or heterocyclic phosphonium or sulfonium salts.

These surfactants are described, for example, in R. Oda, *Surfactants and Application Thereof* (published by Maki Shoten Co., Japan, 1964), H. Horiguchi, *New Surfactants* (published by Sankyo Publishing Co., Japan, 1975), *McCutcheon's Detergents & Emulsifiers* (McCutcheon Divisions, MC Publishing Co., 1985), and JP-A-60-76741, JP-A-62-172343, JP-A-62-173459, JP-A-62-215272.

The compounds of the present invention provide an antistatic effect, which can be combined, if desired, with other antistatic agents in an amount such that the additional antistatic agent does not interfere with the effect of the present invention. Examples of other antistatic agents which can be employed together with the antistatic compounds of the present invention include the fluorine-containing surfactants described in JP-A-62-109044, JP-A-62-215272, the nonionic surfactants described in JP-A-60-76742, JP-A-60-80846, JP-A-60-80848, JP-A-60-80839, JP-A-60-76741, JP-A-58-208743, JP-A-62-172343, JP-A-62-173459, JP-A-62-215272, and the electroconductive nonionic, anionic, cationic or amphoteric polymers or latexes described in JP-A-57-204540, JP-A-62-215272. Additionally, inorganic antistatic agents may also be employed including, for example, ammonium, alkali metal or alkaline earth metal halides, nitrates, perchlorates, sulfates, acetates, phosphates or thiocyanates. Preferred examples of the inorganic antistatic agents are electroconductive tin oxide or zinc oxide as well as composite oxides prepared by doping the metal oxides with antimony or the like as described in JP-A-57-118242. Moreover, other various kinds of charge-transferring complexes, $\pi$-conjugated high polymers and doped products thereof as well as organic metal compounds and interlayer compounds may also be employed as antistatic agents. Examples of such compounds include TCNQ/TTF, polyacetylene and polypyrrole as described, for example, in Morita et al, *Science and Industry*, 59, (3), 103 to 111 (1985, Japan), ibid., 59 (4), 146 to 152 (1985).

Gelatin is advantageously used as the binder or protective colloid for use in the emulsion layers or interlayers of the photographic material of the present invention. However other hydrophilic colloids may also be employed, including, for example, proteins such as gelatin derivatives, graft polymers of gelatin and other high polymer substances, albumin or casein; saccharide derivatives such as cellulose derivatives, for example, hydroxyethyl cellulose, carboxymethyl cellulose or cellulose sulfates, or sodium alginate, dextran or starch derivatives; and various synthetic hydrophilic high polymer substances of homopolymers or copolymers of polyvinyl alcohol, polyvinyl alcohol partial acetal, poly-N-vinylpyrrolidone, polyacrylic acid, polymethacrylic acid, polyacrylamide, polyvinylimidazole or polyvinyl pyrazole.

The gelatin for use in the present invention may be a lime-processed gelatin, an acid-processed gelatin or an enzyme-processed gelatin. Additionally, hydrolyzed or enzyme-decomposed products of gelatin may also be employed.

Above all, a combination of gelatin and dextran or polyacrylamide is preferred.

The photographic material of the present invention can contain polyols such as trimethylolpropane, pentane-diol, butane-diol, ethylene glycol, glycerin or sorbitol as a plasticizer, in the hydrophilic colloid layer.

The silver halide grains constituting the photographic emulsion of the photographic material of the present invention may have a regular crystalline form such as cubic or octahedral crystalline form, or have a spherical or tabular crystalline form, or have a composite crystalline form comprising the above noted crystalline forms. Additionally, the grains may be tabular grains such as those described in *Research Disclosure*, Vol. 225, No. 22534, pages 20 to 58 (April, 1984), JP-A-58-127921, JP-A-58-113926. Depending on the desired application, the grains may be in the form of a mixture comprising grains having different crystalline forms.

In the step of forming and/or growing the silver halide grains for use in the present invention, are least one salt selected from cadmium salts, zinc salts, lead salts, thallium salts, iridium salts (including complexes thereof), rhodium salts (including complexes thereof) and iron salts (including complexes thereof) may be added to the reaction system, such that metal elements derived therefrom are introduced into the inside of the grains and/or onto the surface thereof. Alternatively, the reaction may be carried out in a reducing environment, to thereby incorporate reduced sensitized nuclei into the inside of the grains and/or onto the surface thereof.

After completion of the growth of the silver halide grains, the unnecessary soluble salts may or may not be removed from the final silver halide emulsion. In the latter case, the emulsion contains the soluble salts. When the soluble salts are to be removed, the method described in *Research Disclosure* No. 17643 II (December, 1978) can be employed.

The silver halide grains may have a uniform silver halide composition distribution throughout the grain or may comprise core/shell grains having different silver halide compositions in the inside (core) of the grain and the surface layer (shell) thereof.

The grain size distribution of the silver halide emulsion for use in the present invention is not particularly restricted. For example, a polydispersed emulsion having a broad grain size distribution or a monodispersed emulsion having a narrow grain size distribution may be employed. Two or more different types of emulsions may also be employed in combination. A "monodispersed emulsion" is one having a value (generally 0.20 or less) of the standard deviation of the grain size distrubution divided by the mean grain size. As used herein, the grain size is the diameter of the grain when the grain is spherical, and is the diameter of a circle having the same area as the projected area of the grain when the grain is not spherical. As desired, one or more polydispersed emulsions and monodispersed emulsions may be combined for use in the present invention.

A mixed emulsion comprising a light-sensitive silver halide emulsion and a silver halide emulsion of core-fogged grains, for example, as described in U.S. Pat. Nos. 2,996,382, 3,397,987, 3,705,858 may also be employed in the present invention. The light-sensitive silver halide emulsion and the emulsion containing the core-fogged grains may be arranged in different layers. Addition of the mercapto compounds described in JP-A-61-48832 to these emulsions is further preferred to prevent fog and to improve the storage stability.

The photographic material of the present invention can contain various compounds in the photographic emulsion, for the purpose of preventing fog during the step of manufacture of the material or during storage thereof, or for stabilizing the photographic properties of the material. Such compounds may be known antifoggants or stabilizers, including, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole); mercaptopyrimidines; mercaptotriazines, for example, thioketo compounds such as oxazolinethione; azaindenes such as triazaindenes, tetraazaindenes (especially, 4-hydroxy-substituted (1,3,3a,7)-tetraazaindenes), pentaazaindenes; as well as benzenthiosulfonic acids, benzenesulfinic acids and benzenesulfonic acid amides.

The photographic material of the present invention can contain in the hydrophilic colloid layer a polymer latex which well known in the art, such as an alkyl acrylate homopolymer or copolymer, or a vinylidene chloride copolymer. The polymer latex may be previously stabilized with a nonionic surfactant, as described in JP-A-61-230136.

The photographic material of the present invention can contain various compounds, for example, polyalkylene oxides or derivatives thereof such as ethers, esters or amines thereof, or thioether compounds, thiomorpholines, quaternary ammonium salt compounds, urethane derivatives, urea derivatives, imidazole derivatives or 3-pyrazolidones, in the photographic emulsion layer, to elevate sensitivity and contrast, and to accelerate development.

The photographic emulsion for use in the present invention may be spectral-sensitized with methine dyes or the like. Useful dyes include, for example, cyanine dyes, merocyanine dyes, complex cyanine dyes, complex merocyanine dyes, holopolar cyanine dyes, hemicyanine dyes, styryl dyes and hemioxonole dyes. Especially useful dyes are cyanine dyes, merocyanine dyes and complex merocyanine dyes.

The support of the photographic material of the present invention may have an anti-halation layer comprising, for example, carbon black and other various dyes such as oxonole dyes, azo dyes, arylidene dyes, styryl dyes, anthraquinone dyes, merocyanine dyes and tri- (or di-)arylmethane dyes. In forming the anti-halation layer with the above noted dyes, a cationic polymer or latex may be used in order to prevent the dyes from diffusing out of the anti-halation layer.

The provision of such an anti-halation layer is described, for example, in *Research Disclosure* Item No. 17643 VIII (December, 1978). For the purpose of improving the color tone of the developed silver, the magenta dyes described in JP-A-61-285445 may also be incorporated into the photographic material of the present invention.

The hydrophilic colloid layer for use in the present invention may contain a matting agent containing colloidal silica, strontium barium sulfate, polymethyl methacrylate, methyl methacrylate-methacrylic acid copolymer, the methyl methacrylate-styrenesulfonic acid copolymer described in JP-A-63-216046, or the fluorine group-containing grains described in JP-A-61-230136.

The photographic material of the present invention may contain an inorganic or organic hardening agent in the photographic emulsion layer or other constitutive layers. For example, aldehydes (such as formaldehyde, glyoxal, glutaraldehyde), active vinyl compounds (such as 1,3,5-triacryloyl-hexahydro-s-triazine, 1,3-vinylsulfonyl-2-propanol), active halogen compounds (such as 2,4-dichloro-6-hydroxy-s-triazine), and mucohalogenic acids (such as mucochloric acid, mucophenoxychloric acid) can be used for this purpose, singly or in combination thereof.

Preferred hardening agents for use in the present invention are vinylsulfone compounds of the following formula:

$$(CH_2{=}CH{-}SO_2{-}CH_2)_2{-}A$$

wherein A is a divalent group which may be omitted from the formula.

The photographic material of the present invention can contain a developing agent. The developing agents described in *Research Disclosure*, Vol. 176, page 29, Item of "Developing Agents" can be employed.

In particular, hydroquinone and pyrazolidones are preferably employed.

The photographic material of the present invention may contain yellow-, cyan- and magenta-coloring couplers. For example, useful couplers are described in detail in JP-A-62-215272.

In accordance with the present invention, the means of forming the photographic constitutive layers on the support is not particularly restricted and various conventional techniques such as bar coating, roll coating, knife coating, curtain coating, gravure coating, spray coating, dip coating, or extrusion coating, can be employed.

For processing of the photographic material of the present invention, either black-and-white development of the silver images, or color development of the dye images may be employed. The photographic material of the present invention may be processed by a reversal method for forming images therein, by first carrying out black-and-white negative development and then color development by exposing to a white light or by treating in a fogging agent-containing bath. Alternatively, the dyes are previously incorporated into the photographic material, the material is exposed and then subjected to black-and-white development to form a silver image therein, and thereafter the material is subjected to a silver dye-bleaching process where the dyes in the material are bleached by the action of the bleaching catalyst of the silver image.

The black-and-white processing in accordance with the present invention comprises a development step, a fixing step and a rinsing step. Where stopping is effected after the development step, or stabilization is effected after the fixing step, the rinsing step may be omitted. The photographic material of the present invention may contain a developing agent or a precursor thereof, and it may be processed (developed) using an alkaline solution, alone. If desired, the photographic material of; the present invention may be developed with a lith developer.

The color development in accordance with the present invention comprises a color development step, a bleaching step, a fixing step, a rinsing step and optionally a stabilizing step. In place of the separated bleaching step and fixing step, a mono-bath bleach-fixing step can be effected using a bleach-fixing solution. All of the color development, bleaching and fixation can also be effected in a single bath, where a mono-bath development-bleach-fixing solution is used.

In addition to the above-described processing steps, a pre-hardening step and a neutralization step thereof, a stop-fixing step and a post-hardening step may also be employed in the processing of the photographic material of the present invention. When the photographic material of the present invention contains a color developing agent or a precursor thereof, it may be processed with an activator-containing solution (activator-processing step), in place of the above-described color developer. If desired, the activator-processing step may be combined with the mono-bath processing step.

The processing temperature is generally selected in the range of from 10° C. to 65° C. However, the processing temperature may be higher than 65° C. Preferably, the photographic material of the present invention is processed at a temperature of from 25° C. to 45° C.

The black-and-white developer for processing the photographic material of the present invention may be selected from known black-and-white developers. Various additives generally added to these developers may also be added to the developer for processing the photographic material of the present invention.

Typical useful additives include developing agents such as 1-phenyl-3-pyrazolidone, Metol or hydroquinone; preservatives such as sulfites; alkali accelerators such as sodium hydroxide, sodium carbonate or potassium carbonate; inorganic or organic inhibitors such as potassium bromide, 2-methylbenzimidazole or methylbenzimidazole; hard water softeners such a polyphosphates; as well as surface overdevelopment inhibitors such as iodides (in small amount) or mercapto compounds.

In processing X-ray photographic materials, a reduction of the processing time is desired, and enhancements in this regard are being effected increasingly. Additionally, various means of simplifying the step of processing of the photographic material are being developed. The compounds of the present invention are extremely advantageous for providing excellent photographic materials which conform well to the recent processing techniques.

The following examples illustrate the present invention in more detail, but are not to be construed as limiting the present invention in any way.

EXAMPLE 1

(1) Preparation of Monodispersed Silver Halide Emulsion

An aqueous ammonia was placed in a container heated up to 55° C. containing gelatin, potassium bromide and water. An aqueous silver nitrate solution and an aqueous potassium bromide solution containing a hexachloroiridate(III) in an amount of $10^{-7}$ mol per mol of silver were added thereto by the double-jet method maintaining the pAg value in the reaction system at 7.60. Accordingly, monodispersed silver bromide grains having a mean grain size of 0.55 micron were prepared. In the emulsion, 98% by number of the grains to the total grains had a grain size within ±40% of the mean grain size. The emulsion was desalted and the pH value thereof was adjusted to 6.2 and the pAg value thereof to 8.6. Thereafter, the emulsion was subjected to gold/sulfur sensitization with sodium thiosulfate and chloroauric acid to obtain the excellent photographic property.

The proportion of (100)/(111) of the grains of the emulsion was measured to be 98/2 by the Kubelka-Munk's method. The emulsion was called Emulsion (A).

Next, monodispersed Emulsions (B) and (C) having a mean grain size of 0.35 micron and 0.25 micron, respectively, were prepared in the same manner as above, except that the amount of the ammonia added prior to the formation of the grains wa reduced.

(2) Preparation of Emulsion-Coating Composition 0.333 kg of each of Emulsions (A), (B) and (C) was heated to 40° C. and dissolved, and 70 ml of a methanol solution of an infrared-sensitizing dye having the following structural formula (A) ($9\times10^{-4}$ mol/liter), 90 ml of an aqueous solution of the super-sensitizing agent disodium (i.e., 4,4'-bis[4,6-di(naphthyl-2-oxy) pyrimidin-2-ylamino]stilbene-2,2'-disulfonate ($4.4\times10^{-3}$ mol/liter)), 35 ml of a methanol solution containing a compound having the following structural formula (B) ($2.8\times10^{-3}$ mol/liter), an aqueous solution of 4-hydroxy-6-methyl-1,3,3a,7-tetraazaindene, an aqueous solution of the coating aid (i.e., dodecylbenzenesulfonic acid salt), and an aqueous solution of the tackifier (i.e., polypotassium-p-styrene-sulfonate compound) were added thereto to prepare an emulsion-coating composition.

Formula (A):

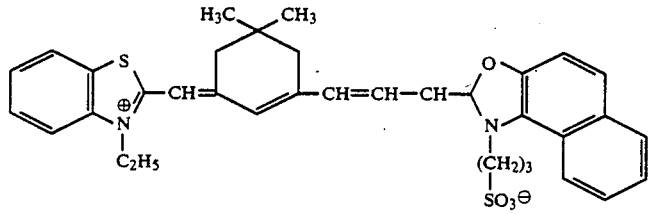

(3) Preparation of Surface-Protective Layer-Coating Composition

To an aqueous 10 wt % gelatin solution (0.9 g/m²) heated to 40° C. were added an aqueous polyacrylamide solution (molecular weight: 40,000, 0.1 g/m²), an aqueous sodium polystyrenesulfonate solution, the matting agent (i.e., polymethyl methacrylate (mean grain size: 2.0 microns)), the hardening agent (i.e., N,N'-ethylene-bis-(vinylsulfonylacetamide)), an aqueous solution of the coating aid (i.e., sodium t-octylphenoxyethoxyethoxyethanesulfonate (20 mg/m²)), and the following compounds.

$C_8F_{17}SO_3K$ (1 mg/m²)

$C_8F_{17}SO_2N(C_3H_7)(CH_2CH_2O)_5(CH_2)_4SO_3Na$ (1 mg/m²)

Accordingly, a surface-protective layer-coating composition was prepared.

(4) Preparation of Backing Layer-Coating Composition

To 1 kg of an aqueous 10 wt % gelatin solution heated to 40° C. were added an aqueous solution of the tackifier (i.e., sodium polystyrenesulfonate), 50 ml of an aqueous solution of dye having the following structural formula (C) ($5\times10^{-2}$ mol/liter), an aqueous solution of the hardening agent (i.e., N,N'-ethylenebis(vinylsulfonylacetamido) and an aqueous solution of the coating aid (i.e., t-octylphenoxyethoxyethoxyethanesulfonate). Accordingly a backing layer-coating composition was prepared.

Formula (C):

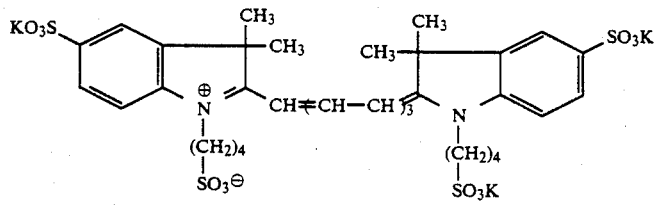

(5) Preparation of Surface-Protective Layer-Coating Composition for the Backing Layer To an aqueous 10 wt % gelatin solution (1 g/m²) heated to 40° C. were added an aqueous solution of tackifier (i.e., sodium polystyrenesulfonate (20 mg/m²)), the matting agent (i.e., methyl methacrylatesodium styrenesulfonate (molar ratio: 97/3 (40 mg/m³)), an aqueous solution of the coating aid (i.e., sodium t-octylphenoxyethoxyethoxyethanesulfonate (20 mg/m²)), an aqueous solution of sodium p-nonylphenoxybutylsulfonate (2 mg/m²), and the following compounds.

$C_8F_{17}SO_3K$ (1 mg/m²)

$C_8F_{17}SO_2N(C_3H_7)(CH_2CH_2O)_4(CH_2)_4SO_3Na$ (1 mg/m²)

To the 10 wt % gelatin solution of surface-protective layer-coating composition for the backing layer thus-prepared was added the compounds of the present invention or the comparative compounds as indicated in Table 1 below. Specifically, in Sample Nos. 1-2 to 1-8, the compounds of the present invention as indicated in Table 1 were dissolved in a mixed solvent of water/methanol (1/0.1, by volume) in a concentration of 2% by weight. The resulting solution was added to the previously prepared 10% gelatin solution of surface-protective layer-coating composition for the backing layer together with the anionic polymer salt indicated in Table 1. Lastly, water was added to the resulting solution such that the gelatin concentration was diluted to 5% by weight.

On the other hand, in Sample No. 1-1 (control) and Sample Nos. 1-9 to 1-13 (comparison), the comparative compound as indicated in Table 1 was added to the previously prepared 10 wt % gelatin solution of surface-protective layer-coating composition, while no additional compound was added to Sample No. 1-1 (control). In Sample Nos. 1-1 to 1-13, the metal ion salt as indicated in Table 1 was added. Lastly, water was added to the resulting solution such that the gelatin concentration was diluted to 5% by weight. Accordingly, the respective control or comparative protective layer-coating composition as indicated in Table 1 was prepared.

(6) Preparation of Coated Sample

The previously prepared backing layer-coating composition was coated on one surface of a polyethylene terephthalate support along with the surface-protective layer-coating composition, the amount of gelatin coated being 4 g/m². Next, the infrared-sensitizing dye-containing emulsion-coating composition prepared in the above step (2) was coated on the outer side of the support along with the surface-protective layer, the amount of silver coated being 3.5 g/m². Coating was effected by an extrusion coating method. The amounts of the other additives in the thus coated layers are indicated as above. The thus prepared film samples were evaluated with respect to the formation of static marks generated by handling with urethane and nylon rollers, the formation of uneven images, contamination of the fixing solution used to process the samples and the number of uneven spots on the coated sample. The methods for evaluation are described below.

(7) The composition of the developer and fixing solution used to process the samples were as follows:

| | |
|---|---|
| Developer: | |
| Potassium hydroxide | 17 g |
| Sodium sulfite | 60 g |
| Diethylenetriaminepentaacetic acid | 2 g |
| Potassium carbonate | 5 g |
| Boric acid | 3 g |
| Hydroquinone | 35 g |
| Diethylene glycol | 12 g |
| 4-Hydroxymethyl-4-methyl-1-phenyl-3-pyrazolidone | 1.65 g |
| 5-Methylbenzotriazol | 0.6 g |
| Acetic acid | 1.8 g |
| Potassium bromide | 2 g |
| Water to make | 1 liter |
| pH | 10.50 |
| Fixing Solution: | |
| Ammonium thiosulfate | 140 g |
| Sodium sulfite | 15 g |
| Disodium ethylenediaminetetraacetate dihydrate | 25 mg |
| Potassium hydroxide | 6 g |
| Water to make | 1 liter |
| Acetic acid to provide pH of | 4.95 |

The processing steps were as follows:

| Processing Steps | Temperature | Time |
|---|---|---|
| Development | 35° C. | 11.5 sec |
| Fixing | 35° C. | 12.5 sec |
| Rinsing in water | 20° C. | 7.5 sec |
| Drying | 60° C. | — |

-continued

| Dry-to-Dry Processing Time: 60 seconds |
|---|

(8) Evaluation of Static Mark-Resistance

A non-exposed sample was conditioned at a temperature of 25° C. and a relative humidity of 10% RH for 2 hours. Next, the thus-conditioned sample was rubbed with a urethane rubber roller and a nylon rubber roller in the same dark room and in the same manner, for the evaluation of static marks, if any, occurring on the rubbed sample. The thus-treated sample was developed by the process described above.

The static mark-resistance was evaluated on the basis of the following four ranks.

A: No static marks present.

B: Some static marks present.

C: Many static marks present.

D: Extremely many static marks present over the entire sample surface.

(9) Evaluation of Unevenness of Image Formed

A sample film (size: 25 cm×30 cm) was irradiated with an infrared light such that the density of the image formed after development would be 1.5 (as measured with a Macbeth densitometer). The thus-exposed sample was processed in accordance with the above-described processing procedure comprising development, fixing, rinsing and drying. The unevenness of the image thus-formed was evaluated on the basis of the following four ranks.

A: No uneven portions were observed. (Image was quite even.)

B: Some uneven portions were observed.

C: Many uneven portions were observed.

D: Extremely many uneven portions were observed over the entire sample surface.

(10) Evaluation of Contamination of Fixing Solution

A sample (size: 25 cm×30 cm) was exposed with an infrared light such that the density of the formulater development would be 1.5 (as measured with Macbeth densitometer), and was processed with a fresh developer and a fresh fixing solution. In the same manner, 500 samples were processed in the same developer and fixing solution in sequence. After the test, the extent of the insoluble substance, if any, that was floating in the fixing solution thus-used was evaluated on the basis of the following four ranks. The amount of the replenisher to each of the developer and the fixing solution was 50 ml/sheet and 60 ml/sheet, respectively.

A: No floating substance was observed.

B: Some floating substances were observed.

C: Many floating substances were observed.

D: Extremely many floating substances were observed.

(11) Evaluation of Coating Property

For evaluating the coating property of the coating compositions, the number of the spots on the side of the emulsion layer surface was counted per $m^2$ of the film. Increase of the number indicates poorer coating property.

TABLE 1

| Sample No. | Compounds of the Present Invention in Protective Layer: Compounds of Formula (I) ($mg/m^2$) | Compounds of the Present Invention in Protective Layer: Anionic Polymer Salt ($mg/m^2$) | Static Marks: Urethane | Static Marks: Nylon | Uneveness of Image | Contamination of Fixing Solution | Coating Property (Number of Spots) |
|---|---|---|---|---|---|---|---|
| 1-1 (control) | — | — | D | D | D | A | 1 |
| 1-2 (invention) | P-1 (50) | Sodium Polyacrylate (20) | A | A | A | A | 1 |
| 1-3 (invention) | P-3 (50) | Sodium Polyacrylate (20) | A | A | A | A | 1 |
| 1-4 (invention) | P-14 (50) | Sodium Polyacrylate (20) | B | A | A | A | 1 |
| 1-5 (invention) | P-32 (50) | Sodium Polystyrene-sulfonate (20) | A | A | A | A | 1 |
| 1-6 (invention) | P-41 (50) | Sodium Polystyrene-sulfonate (20) | B | A | A | A | 0 |
| 1-7 (invention) | P-43 (50) | Sodium Polystyrene-sulfonate (20) | B | A | A | A | 2 |
| 1-8 (invention) | P-50 (50) | Sodium Polystyrene-sulfonate (20) | A | A | A | A | 2 |
| 1-9 (comparison) | Comparative Compound A (45) | — | A | A | D | D | 2 |
| 1-10 (comparison) | Comparative Compound B (50) | — | C | B | D | A | 1 |
| 1-11 (comparison) | Comparative Compound C (50) | — | D | D | B | C | 10 |
| 1-12 (comparison) | P-1 (50) | — | B | B | C | C | 5 |
| 1-13 (comparison) | P-1 D | $CF_3SO_3Li$ (5) | D | B | C | C | 4 |

Comparative Compound (A):

$C_{16}H_{33}O(CH_2CH_2O)_{10}H$

Comparative Compound (B):

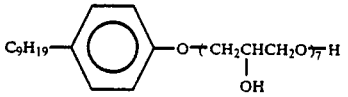

Comparative Compound (C):

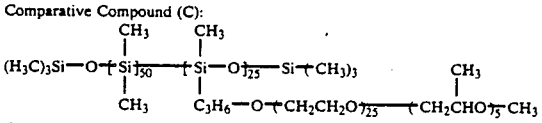

(Mw is about 2500)

As is apparent from the results of Table 1 above, the samples Nos. (1-2) to (1-8) containing the compounds of the present invention were excellent in providing even images and were free from the formation of static marks and contamination of the fixing solution. Additionally, the coating property of the coating compositions of the samples of the present invention was also good.

On the other hand, Sample No. (1-1) (control) is poor with respect to static marks and uneven image because it did not contain the compounds of the present invention. In particular, static marks were formed thereon, and the image formed therein was uneven. The comparative Samples Nos. (1-9) and (1-11) which contained a polyoxyethylene group-containing nonionic surfactant were much inferior to the samples of the present invention, with respect to the formation of uneven images and contamination of the fixing solution. The comparative Sample No. (1-12) contained only the phosphagen polymer of the present invention, and the comparative Sample No. (1-13) contained the phosphagen polymer of the present invention together with a metal ion salt. However, Sample No. (1-12) is poor in each of the evaluations. Sample No. (1-13) also is poor with respect to static mark resistance to nylon, although the sample provided good results with respect to static mark resistance to urethane. Additionally, Sample No. (1-13) formed an uneven image and contaminated the fixing solution. The comparative Sample No. (1-10) containing a glycidol compound is poor with respect to static mark-resistance.

It is clearly seen from the results in Table 1 that the film samples containing the compounds of the present invention is good in each of the evaluations. Namely, the samples of the present invention did not form static marks, provided even images, did not contaminate the fixing solution used to process the samples, and the coating property of the compositions used to prepare the samples was good. On the basis of those results, the superiorities of the present invention are apparent.

EXAMPLE 2

(1) Preparation of Tabular Silver Halide Grains

Potassium bromide, thioether ($HO(CH_2)_2S(CH_2)_2S—(CH_2)_2OH$) and gelatin were dissolved in an aqueous solution and heated to 70° C. To this solution were added a silver nitrate solution and a mixed solution of potassium iodide and potassium bromide using the double-jet method. After addition, the resulting blend was cooled to 35° C. and the soluble salts were removed by flocculation. Next, the resulting liquid was again heated to 40° C. and 60 g of gelatin was added thereto and dissolved. The pH value was then adjusted to 6.8. The tabular silver halide grains thus-formed had a mean grain size (diameter) of 1.24 microns, a thickness of 0.17 micron, a mean aspect ratio of diameter/thickness of 7.3 and a silver iodide content of 3 mol %. At 40° C., the pAg value was 8.95.

The emulsion was then chemical-sensitized by gold-/sulfur sensitization. Next, 500 mg per mol of silver of the sensitizing dye anhydro-5,5'-dichloro-9-ethyl-3,3'-di(3-sulfopropyl)oxacarbocyanine-hydroxide sodium salt and 200 mg of potassium iodide per mol of silver were added to the resulting emulsion for effecting green-sensitization. Additionally, as stabilizers, 4-hydroxy-6-methyl-1,3,3a,7-tetraazaindene (250 mg/m$^2$) and 2,6-bis(hydroxyamino)-4-diethylamino-1,3,5-triazine (270 mg/m$^2$) as well as dextran having a weight average molecular weight ($\overline{MW}$) of 40,000 and a latex solution (230 mg/m$^2$ as a solid content) of ethyl acrylate/acrylic acid (mol ratio: 95/5) containing the following nonionic surfactant (a) in an amount of 3% by weight of the latex solid content were added to the emulsion. Accordingly, a tabular grain-containing emulsion-coating composition was prepared. The coating composition had a specific gravity of 1.175; the specific gravity ratio of silver/gelatin was 1.30; and the specific gravity ratio of dextran/gelatin was 0.30.

Nonionic Surfactant (a):

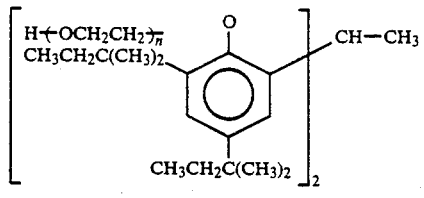

(n is about 15)

(2) Preparation of Surface-Protective Layer-Coating Composition

Gelatin, the coating aid (i.e., sodium p-t-octylphenoxyethoxyethoxyethanesulfonate), fluorine-containing surfactants, (i.e., $C_8F_{17}SO_3K$ and $$C_8F_{17}SO_2N(C_3H_7)(CH_2CH_2O)_5(CH_2)_4SO_3Na)$$

the hardening agent (i.e., N,N'-ethylenebis-(vinylsulfonylacetamide), polyacrylamide having a weight average molecular weight ($\overline{MW}$) of 8,000 and polymethyl methacrylatee grains (mean grain size: 3.5 microns) were blended to provide a 10 wt % gelatin solution A phosphagen polymer compound of the present invention as indicated in Table 2 in a mixed solvent of water/-methanol (1/0.1, by volume) having a concentration of 2% by weight was added thereto. Additionally, the anionic polymer salt as indicated in Table 2 was also added thereto. Lastly, water was added to the resulting solution such that the gelatin concentration therein was diluted to 5% by weight. Accordingly, the coating composition was prepared.

On the other hand, in Sample No. (2-1) (control) and Sample Nos. (2-9) to (2-13) (Comparison), the comparative compound as indicated in Table 2 was added to the previously prepared 10 wt % gelatin solution, while no phosphagen compound was added to Sample No. (2-1). In Sample No. (2-13), the metal ion salt indicated in Table 2 was added. Lastly, water was added to the resulting solution such that the gelatin concentration therein was diluted to 5% by weight. Accordingly, the respective control or comparative coating composition was prepared.

(3) Formation of Photographic Material Sample

The previously prepared emulsion-coating composition and surface-protective layer-coating composition were coated on a subbing layer-coated polyethylene terephthalate film support (thickness: 180 microns) in the above described order by a co-extrusion coating method to obtain the emulsion layer and the surface protective layer, and then dried. The silver amount in the coated emulsion layer was 2.0 g/m$^2$. In the coated surface-protecting layer, the gelatin content was 0.80 g/m$^2$, the sodium p-t-octylphenoxyethoxyethoxyethanesulfonate content was 20 mg/m$^2$, the fluorine-containing surfactant (i.e., $C_8F_{17}SO_3K$) content was 5 mg/m$^2$, the second fluorine-containing surfactant $$\text{(i.e., } C_8F_{17}SO_2\overset{\overset{C_3H_7}{|}}{N}(CH_2CH_2O)_5(CH_2)_4SO_3Na\text{)}$$

content was 1 mg m$^2$, the hardening agent content was 40 mg/m$^2$, the polyacrylamide content was 0.80 g/m$^2$ and the polymethyl methacrylate grain content was 50 mg/m$^2$. The other surface of the support was also coated in the same manner as above to form a layer having the same constitution thereon.

The thus-prepared sample was evaluated in the same manner as in Example 1, with respect to the static mark-resistance, uneven image, contamination of the fixing solution used to process the samples and the number of spots on the coated layer. The process of development, fixing and rinsing was carried out by the same manner as in Example 1, except that the developer additionally contained 5 g of glutaraldehyde and the fixing solution additionally contained 10 g of potassium aluminium sulfate.

The results obtained are shown in Table 2 below.

TABLE 2

| Sample No. | Compounds of the Present Invention in Protective Layer: Phosphagen Polymer (mg/m$^2$) | Anionic Polymer Salt (mg/m$^2$) | Static Marks: Urethane | Static Marks: Nylon | Unevenness of Image | Contamination of Fixing Solution | Coating Property (Number of Spots |
|---|---|---|---|---|---|---|---|
| 2-1 (control) | — | — | D | D | D | D | 3 |
| 2-2 (invention) | P-1 (50) | Sodium Polyacrylate (20) | B | A | A | A | 1 |
| 2-3 (invention) | P-3 (50) | " | B | A | A | A | 1 |
| 2-4 (invention) | P-14 (50) | " | B | A | A | A | 0 |
| 2-5 (invention) | P-32 (50) | " | A | A | A | A | 1 |
| 2-6 (invention) | P-41 (50) | Sodium Polystyrene-sulfonate (20) | B | A | A | A | 0 |
| 2-7 (invention) | P-43 (50) | Sodium Polystyrene-sulfonate (20) | A | A | A | A | 1 |
| 2-8 (invention) | P-50 (50) | Sodium Polystyrene-sulfonate (20) | A | A | A | A | 0 |
| 2-9 (comparison) | Comparative Compound A (45) | — | B | A | C | D | 5 |
| 2-10 (comparison) | Comparative Compound B (50) | — | B | C | B | B | 2 |
| 2-11 (comparison) | Comparative Compound C (50) | — | B | D | D | D | 17 |
| 2-12 (comparison) | P-1 (50) | — | B | A | C | D | 13 |
| 2-13 (comparison) | P-1 (50) | $CF_3SO_3Li$ (5) | A | A | C | D | 11 |

It is clearly seen from the results presented in Table 2 above, that Sample Nos. (2-2) to (2-8) containing the compounds of the present invention were excellent in each of the evaluation. Namely, the samples of the present invention provided even images, were free from the formation of static marks, and did not contaminate the fixing solution used to process the samples. Additionally, the coating property of the coating compositions of the samples of the present invention was good.

On the other hand, Sample No. (2-1) (control) provided poor results namely an uneven image, and contamination of the fixing solution used to process the control samples. Additionally, extreme static marks were formed thereon. The comparative Sample Nos. (2-9) to (2-13) did not provide favorable results in any of the evaluations including formation of static marks, uneven image, contamination of the fixing solution used to process the samples and coating property of the coating compositions.

From the above-described results, the excellent effect of the compounds of the present invention is apparent.

EXAMPLE 3

Color photographic negative film Sample Nos. (3-1) to (3-12) were prepared in the same manner as in Example 2, except that the tabular silver halide grain-containing emulsion layer of Example 2 was replaced by the first to fourth layers of Sample No. 202 in Example 3 of JP-A-63-264740. The samples were processed in accordance with the process of Example 3 of JP-A-63-264740.

As a result, all Sample Nos. (3-2) to (3-7) of the present invention provided favorable results in each of the evaluation including the formation of static marks, uneven images, contamination of the fixing solution used to process the samples and coating property of the coating compositions.

On the other hard, the comparative Sample Nos. (3-8) to (3-12) and Sample No. (3-1)(control) did not provide favorable results in any of the evaluation.

EXAMPLE 4

The photographic layers of Sample No. 104 in Example 2 of JP-A-63-264760 were coated on one surface of a cellulose triacetate support; while the following backing layers were coated on the other surface thereof.

| | |
|---|---|
| First Backing Layer: | |
| Compounds of the present Invention (The same compounds as in Example 1 were used in the same amounts.) | |
| Diethylene glycol | 10 mg/m$^2$ |
| The components were dissolved in a mixed solvent of water/methanol, and then coated. | |
| Second Backing Layer: | |
| Diacetyl cellulose | 200 mg/m$^2$ |
| Stearic acid | 10 mg/m$^2$ |
| Cetyl stearate | 20 mg/m$^2$ |
| Silica grains (grain size: 0.3 micron) | 30 mg/m$^2$ |

The components were dissolved in a mixed solvent of acetone/methanol/water and coated.

Sample Nos. (4-1) to (4-12) thus-prepared were processed in accordance with the process of Example 2 in JP-A-63-264740.

The thus processed samples were examined and evaluated in the same manner as in Example 1.

As a result, it was found that all Sample Nos. (4-2) to (4-7) of the present invention provided favorable results in each of the evaluation including the formation of static marks, uneven images, contamination of the fixing solution used to process the samples, and coating property of the coating compositions.

On the other hand, the comparative Sample Nos. (4-8) to (4-12) and Sample No. (4-1) (control) did not provide favorable results in any of the evaluation.

EXAMPLE 5

(5-1) Subbing Layers under Emulsion Layer (i) Synthesis of Poly(methyl Methacrylate/Co-Ethyl Acrylate/Co-Acrylic Acid)

1.5 g of sodium dodecylnitrate was weighed into a one-liter three-neck flask equipped with a stirring device and a reflux tube, and dissolved in 300 ml of water. Next, the reactor (flask) was heated to 75° C. in a nitrogen stream atmosphere and the content therein was stirred at 200 rpm. To this was added 40 g of an aqueous 3% potassium persulfate. Next, a mixed solution containing 150 g of methyl methacrylate, 87.5 g of ethyl acrylate and 12.5 g of acrylic acid was dropwise added thereto over a period of 3 hours, whereupon 10 g of a 3% potassium persulfate was added thereto each of six times at every 30 minute interval from the beginning of the dropwise addition of the mixed solution. After addition of the monomer mixture, the reactor was maintained at 75° C. for an additional 2 hours. As a result, an aqueous dispersion of a copolymer having a mean molecular weight of 250,000 was obtained. This was neutralized with an aqueous 10% potassium hydroxide solution to provide a pH value of 7.0.

(ii) Formation of First Subbing Layer under Emulsion Layer

To the previously prepared copolymer-containing aqueous dispersion was added 2,4-dichloro-6-hydroxy-1,3,5-triazine sodium salt in an amount of 4% by weight of the copolymer. Next, fine polystyrene grains having a mean grain size of 2 microns were added thereto in an amount such that the grains were coated in an amount of 1.0 mg/m$^2$. Accordingly, the first subbing layer-coating composition was prepared.

On the other hand, a biaxially oriented polyethylene terephthalate film having a thickness of 100 microns and a width of 30 cm was treated by corona-discharging treatment as described below. Namely, the film was conveyed at a speed of 30 m/min, the distance between the corona-discharging electrodes and the polyethylene terephthalate film was 1.8 mm, and the electric power for discharge was 200 W. The copolymer-containing aqueous dispersion prepared as described above was coated onto the thus corona-discharge treated polyethylene terephthalate film support in a dry thickness of 0.1 micron using a bar-coating method, and then dried at 185° C. Accordingly, the first subbing layer was formed.

(iii) Formation of Second Subbing Layer under Emulsion Layer

The surface of the first subbing layer as formed in the above-described step (ii) was subjected to corona-discharging treatment, whereupon the film-conveying speed was 30 m/min, the discharge between the corona-discharging electrodes and the film was 1.8 mm, and the electric power was 120 W. An aqueous dispersion containing a copolymer of vinylidene chloride/methyl methacrylate/methyl acrylate/acrylonitrile (90/5/4/1, by weight) was coated o the thus corona-discharge treated first subbing layer in a dry thickness of 0.4 micron using a gravure-coating method, and then dried at 120° C.

(iv) Formation of Third Subbing Layer under Emulsion Layer

The surface of the second subbing layer as formed in the above-described step (iii) was subjected to corona-discharging treatment, whereupon the film-conveying speed was 30 m/min, the distance between the corona-discharging electrodes and the film was 1.8 mm, and the electric power was 250 W. The coating composition (iv-a) described below was coated over the thus corona-discharge treated second subbing layer in an amount of 20 ml/m$^2$ using an extrusion coating method, and then dried to form a third subbing layer to be coated with the emulsion layer described below.

(iv-a) Coating Composition for Third Subbing Layer under Emulsion Layer

| | |
|---|---|
| Gelatin | 1.0 wt % |
| Methyl cellulose | 0.05 wt % |
| $C_{12}H_{23}O—(CH_2CH_2O)_{10}—H$ | 0.03 wt % |
| Water to make | 100 wt % |

As described above, the first to third subbing layers were formed, and the third subbing layer is coated with the emulsion layer described below.

(5-2) Subbing Layers under Backing Layer (i) Formation of First Subbing Layer under Backing Layer The same second subbing layer as that formed in the above-described step (5-1)(ii) was formed on the opposite surface of the polyethylene terephthalate film support by the same manner as coated with the subbing layers in the above-described process (5-1).

(ii) Formation of Second Subbing Layer under Backing Layer

The same second subbing layer as that formed in the above-described step (5-1) (iii) was formed on the first subbing layer formed in the previous step (i).

(iii) Formation of Third Subbing Layer under Backing Layer

The surface of the second subbing layer formed in the previous step (ii) was subjected to corona-discharging treatment, whereupon the film-conveying speed was 30 m/min, the distance between the corona-discharging electrodes and the film was 1.8 mm, and the electric power was 250 W. Next, the coating composition (iii-a) described below was coated over the thus corona-discharge treated second subbing layer in an amount of 20 ml/m,$^2$ and dried. Accordingly, a third subbing layer subsequently coated with the backing layer described below was formed.

(iii-a) Coating Composition for Third Subbing Layer under Backing Layer

| | |
|---|---|
| Gelatin | 1.0 wt % |
| Methyl cellulose | 0.05 wt % |
| $C_{12}H_{25}O—(CH_2CH_2O)_{10}—H$ | 0.03 wt % |
| Compound of the Present Invention or Comparative Compound (same as that | The concentration was adjusted such that the amount therein was |

-continued

| | |
|---|---|
| employed in Example 1) | same as that in Example 1. |
| Water to make | 100 wt % |

(5-3) Formation of Silver Halide Emulsion Layer

An aqueous silver nitrate solution and an aqueous solution containing sodium chloride and potassium bromide were simultaneously added to an aqueous gelatin solution maintained at 50° C. in the presence of rhodium chloride of $2\times20^{-5}$ mol per mol of silver, at a constant speed over a period of 30 minutes. Accordingly, a monodispersed silver chlorobromide emulsion having a mean grain size of 0.2 micron was prepared. The AgCl content in the grains was 95 mol %.

The emulsion was desalted using a flocculation method. Next, 1 mg per mol of silver of thiourea dioxide and 0.6 mg per mol of silver of chloroauric acid were added thereto, and the silver halide grains were ripened and fogged at 65° C. to finally obtain the excellent property.

The following compounds were further added to the thus prepared emulsion.

| | |
|---|---|
| 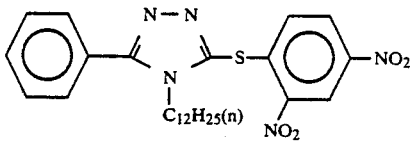 | $2\times10^{-2}$ mol per mol of Ag |
| 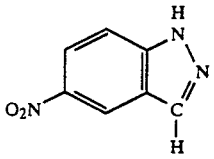 | $1\times10^{-3}$ mol per mol of Ag |
| 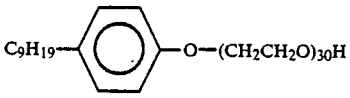 | $4\times10^{-4}$ mol per mol of Ag |
| KBr | 20 mg/m$^2$ |
| Sodium polystyrenesulfonate | 40 mg/m$^2$ |
| 2,6-Dichloro-6-hydroxy-1,3,5-triazine sodium salt | 30 mg/m$^2$ |

The thus prepared composition was coated on the third subbing layer as previously formed in the step (5-1) (iv) in an amount of 3.5 g/m$^2$ as silver.

| (5-4) Composition of Emulsion-Protective Layer: | |
|---|---|
| Gelatin | 1.5 g/m$^2$ |
| Fine $SiO_2$ grains (mean grain size: 4 microns) | 50 mg/m$^2$ |
| Sodium Dodecylbenzenesulfonate | 50 mg/m$^2$ |
| 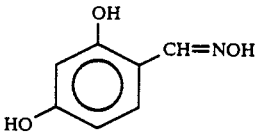 | 20 mg/m$^2$ |
| 5-nitroindazole | 15 mg/m$^2$ |
| 1,3-Divinylsulfonyl-2-propanol | 50 mg/m$^2$ |
| N-perfluorooctanesulfonyl-N-propylglycine potassium salt | 2 mg/m$^2$ |
| Ethyl acrylate latex (mean grain size: 0.1 micron) | 300 mg/m$^2$ |
| 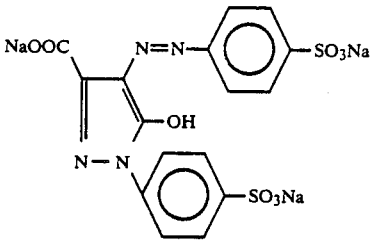 | 100 mg/m$^2$ |

| (5-5) Composition of Backing Layer: | |
|---|---|
| Gelatin | 2.5 g/m$^2$ |
| 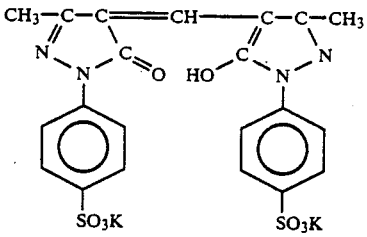 | 30 mg/m$^2$ |

-continued

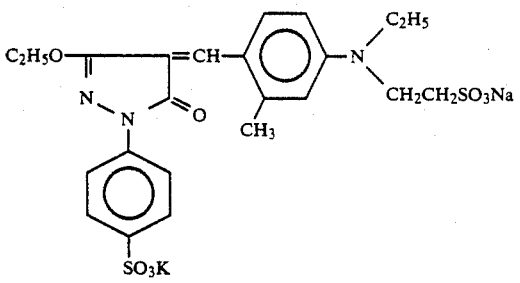

140 mg/m²

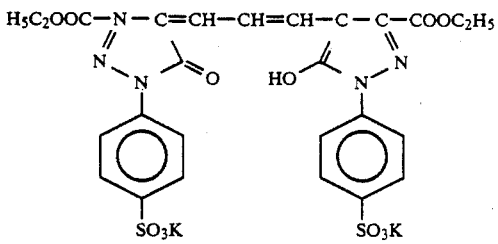

40 mg/m²

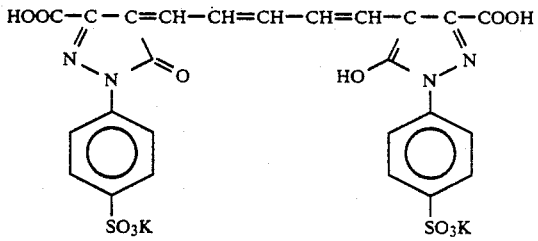

80 mg/m²

| | |
|---|---|
| 1,3-Divinylsulfonyl-2-propanol | 150 mg/m² |
| Ethyl acrylate latex (mean grain size: 0.1 micron) | 900 mg/m² |
| Sodium dihexyl-alpha sulfosuccinate | 35 mg/m² |
| Sodium dodecylbenzenesulfonate | 35 mg/m² |
| (5-6) Composition of Backing Layer-Protective Layer: | |
| Gelatin | 0.8 g/m² |
| Fine polymethyl methacrylate grains (mean grain size: 3 micron) | 20 mg/m² |
| Sodium dihexyl-alpha-sulfosuccinate | 10 mg/m² |
| Sodium dodecylbenzenesulfonate | 10 mg/m² |
| Sodium acetate | 40 mg/m² |

(5-7) Formation of Film Sample

The silver halide emulsion-coating composition prepared in (5-3), and the emulsion-protective layer-coating composition prepared in (5-4), were coated on the third subbing layer which was previously coated on the polyethylene terephthalate film support in that order, using an extrusion-coating method. Next, the backing layer-coating composition and the backing layer-protecting layer-coating composition both prepared as described above were simultaneously coated on the third subbing layer of the opposite side of the same support using a co-extrusion coating method. Accordingly, photographic film Sample Nos. (5-1) to (5-12) were prepared.

Development of these samples was carried out by the use of an automatic developing machine (FG-660 Type of Fuji Photo Film Co.), whereupon GRD-1 and GRF-1 (products of Fuji Photo Film Co.) were used as the developer and the fixing solution, respectively. The processing temperature was 38° C. and the processing time was 20 seconds. The drying temperature was 45° C.

The thus processed Sample Nos. (5-1) to (5-12) were tested and evaluated in the same manner as in Example 1.

As a result, it was found that all Samples Nos. (5-2) to (5-7) of the present invention provided favorable results in each of the evaluation including the formation of static marks, uneven images, contamination of the fixing solution used and coating property of the coating compositions. Additionally, the images formed on the samples of the present invention were all excellent.

On the other hand, Sample No. (5-1) (control) and the comparative Sample Nos. (5-8) to (5-12) did not give favorable results in any of the evaluation criteria.

Based on the above presented results, it is clearly seen that the present invention is superior to the conventional prior art techniques.

In summary, the photographic material of the present invention has excellent properties. Namely, the present invention is resistant to the formation of static marks, does not form uneven images, does not contaminate the fixing solution used to process the material, and provides good coating property of the coating compositions used to fabricate the photographic material.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one of silver halide emulsion layers and other hydrophilic colloid layers wherein said at least one of silver halide emulsion layers and hydrophilic colloid layers contains both a phosphagen polymer having a polyalkylene oxide group or a polyglycerol group in the side chain thereof and an anionic polymer salt.

2. The silver halide photographic material as in claim 1, wherein said phosphagen polymer comprises repeating units represented by formula (I):

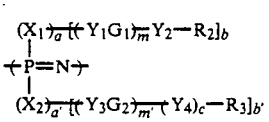

(I)

wherein $X_1$ and $X_2$ represent (b+1)-valent and (b'+1)-valent linking groups, respectively;

b and b' are independently 1 or 2;

when b and b' are 1, $X_1$ and $X_2$ each represents $-Y_5L_1-$;

$L_1$ represents a divalent linking group;

when b and b' are 2, $X_1$ and $X_2$ each represents a group represented by formula (II):

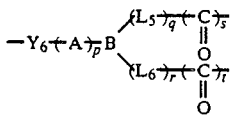

(II)

wherein A represents

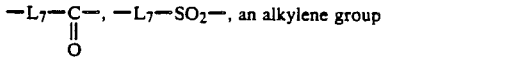

having from 1 to 6 carbon atoms or an arylene group having from 1 to 10 carbon atoms or an aralkylene group;

B represents

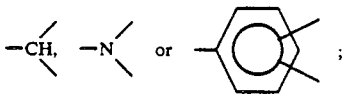

$L_5$, $L_6$ and $L_7$ each has the same meaning as $L_1$;

p, q, r, s and t are independently 0 or 1;

$Y_1$, $Y_3$, $Y_5$ and $Y_6$ each represents

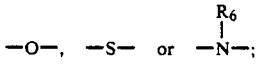

$R_6$ represents a hydrogen atom or an alkyl or alkenyl group having from 1 to 6 carbon atoms;

a and a' each is 0 or 1; provided that when a and a' are both 0, b and b' are 1;

$Y_2$ and $Y_4$ each represents

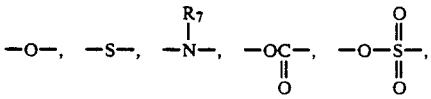

or an alkylene group having from 1 to 6 carbon atoms;

$R_7$ has the same meaning as $R_6$;

c is 0 or 1;

$G_1$ and $G_2$ each represents

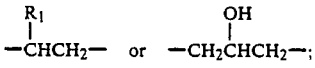

$R_1$ represents a hydrogen atom or an alkyl group having from 1 to 4 carbon atoms;

$R_2$ and $R_3$ each represents a hydrogen atom, an alkyl or alkenyl group having from 1 to 4 carbon atoms, or

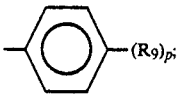

$R_9$ represents a mono-valent substitutable group;

p represents an integer of from 0 to 5; and m and m' are independently an integer of from 1 to 30.

3. The silver halide photographic material as in claim 2, wherein said phosphagen polymer further contains repeating units represented by formula (V):

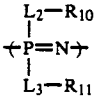

(V)

wherein $R_{10}$ and $R_{11}$ each represents an alkyl, alkenyl, aryl or aralkyl group having from 1 to 12 carbon atoms or a $-(R_{12}O)_e-R_{13}$ group, which may be further substituted, wherein e is 1, 2 or 7; $R_{12}$ represents an alkylene group having from 2 to 4 carbon atoms; $R_{13}$ represents an alkyl, alkenyl, aryl or aralkyl group having a total carbon number of from 1 to 12; and $L_2$ and $L_3$ each represents

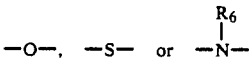

wherein $R_6$ represents a hydrogen atom or an alkyl or alkenyl group having from 1 to 6 carbon atoms.

4. The silver halide photographic material as in claim 1, wherein said anionic polymer salt is formed with a metal ion belonging to the Group Ia and Group IIa of the Periodic Table.

5. The silver halide photographic material as in claim 4, wherein said anionic polymer salt is formed with a metal ion selected from the group consisting of Li, Na, K, Mg and Ca.

6. The silver halide photographic material as in claim 1, wherein said anionic polymer salt has a molecular weight of from 10,000 to 1,000,000.

7. The silver halide photographic material as in claim 2, wherein said repeating units represented by formula (I) comprise 50 mol % or more of the phosphagen polymer.

8. The silver halide photographic material as in claim 1, wherein said phosphagen polymer has a weight average molecular weight of from 1,000 to 3,000,000.

9. The silver halide photographic material as in claim 1, wherein said phosphagen polymer and said anionic polymer salt are added to a hydrophilic colloid layer selected from the group consisting of a surface protective layer, a backing layer, an interlayer and a subbing layer.

10. The silver halide photographic material as in claim 1, wherein said phosphagen polymer and said anionic polymer salt are each added to the photographic material in an amount of from 0.0001 to 2.0 g per $m^2$ of the photographic material.

* * * * *